US008936180B2

(12) United States Patent
Sell

(10) Patent No.: US 8,936,180 B2
(45) Date of Patent: Jan. 20, 2015

(54) AEROSOL TRIGGER SPRAYER AND METHODS FOR MAKING THE SAME

(75) Inventor: Steven A. Sell, Belton, MO (US)

(73) Assignee: MeadWestvaco Calmar, Inc., Richmond, VA (US)

( * ) Notice: Subject to any disclaimer, the term of this patent is extended or adjusted under 35 U.S.C. 154(b) by 0 days.

(21) Appl. No.: 13/817,026

(22) PCT Filed: Aug. 23, 2011

(86) PCT No.: PCT/US2011/048774

§ 371 (c)(1),
(2), (4) Date: Feb. 14, 2013

(87) PCT Pub. No.: WO2012/027344

PCT Pub. Date: Mar. 1, 2012

(65) Prior Publication Data

US 2013/0140333 A1 Jun. 6, 2013

Related U.S. Application Data

(60) Provisional application No. 61/376,007, filed on Aug. 23, 2010.

(51) Int. Cl.

| | |
|---|---|
| ***B65D 83/14*** | (2006.01) |
| ***B65D 83/20*** | (2006.01) |
| ***H01F 17/00*** | (2006.01) |
| ***H01F 17/04*** | (2006.01) |

(52) U.S. Cl.

CPC ..... *B65D 83/206* (2013.01); *H01F 17/0013* (2013.01); *H01F 17/04* (2013.01)

USPC ..... 222/402.13; 222/402.15

(58) Field of Classification Search

CPC ..... B65D 83/22; B65D 83/205; B65D 83/46; B65D 83/201; B65D 83/206

USPC ..... 222/402.21, 402.15, 402.13, 402.11, 222/153.01, 153.02, 153.05, 153.06, 222/153.07, 153.14, 153.13, 321.8; 239/526

See application file for complete search history.

(56) References Cited

U.S. PATENT DOCUMENTS

| | | | | |
|---|---|---|---|---|
| 4,171,758 | A * | 10/1979 | Corba | 222/402.11 |
| 4,550,865 | A * | 11/1985 | Hirao et al. | 222/402.21 |
| 5,915,597 | A * | 6/1999 | De Laforcade | 222/182 |
| 6,874,663 | B2 * | 4/2005 | Scheindel | 222/402.15 |
| 7,036,691 | B2 * | 5/2006 | Nicolas | 222/321.6 |
| 2007/0023457 | A1 * | 2/2007 | O'Toole et al. | 222/402.13 |
| 2007/0034653 | A1 | 2/2007 | Strand | |
| 2007/0051754 | A1 * | 3/2007 | Strand et al. | 222/402.13 |
| 2009/0050650 | A1 * | 2/2009 | Walters et al. | 222/153.11 |
| 2009/0289086 | A1 * | 11/2009 | De Laforcade | 222/402.13 |
| 2011/0192867 | A1 * | 8/2011 | Best et al. | 222/402.13 |

FOREIGN PATENT DOCUMENTS

| | | |
|---|---|---|
| JP | 2009 214917 | 9/2009 |
| WO | 2007/149459 | 12/2007 |

OTHER PUBLICATIONS

International Search Report for PCT/US2011/048774 dated Mar. 14, 2012.

* cited by examiner

*Primary Examiner* — Paul R Durand
*Assistant Examiner* — Charles P Cheyney
(74) *Attorney, Agent, or Firm* — MeadWestvaco Intellectual Property Group

(57) ABSTRACT

An aerosol trigger actuator having two or three parts includes one or more living hinges (170) allowing the two or three parts to act together to release a product from a container.

17 Claims, 8 Drawing Sheets

AEROSOL TRIGGER SPRAYER AND METHODS FOR MAKING THE SAME

CROSS-REFERENCE TO RELATED APPLICATIONS

This application claims the benefit of U.S. Provisional Application No. 61/376,007, entitled "AEROSOL TRIGGER SPRAYER AND METHODS FOR MAKING THE SAME," filed 23 Aug. 2010, and incorporates the same herein by reference in its entirety.

BACKGROUND OF THE INVENTION

1. Field of the Invention

The present invention relates to aerosol sprayer devices and more particularly to simplified aerosol actuators.

2. State of the Art

Spray devices are well known and are used to deliver a variety of products. For example, finger pumps and trigger sprayers may be used to deliver a fluid from a container onto a surface or into a volume of space. Similarly, aerosol sprayers are used to spray an aerosolized product onto a surface or into a volume of space. Many different types of spray devices are known.

Aerosol spray devices typically include a pushbutton type spray device containing an orifice and a connection to a valve which is in turn connected to a container of product from which the aerosol product is dispensed. Actuation of the pushbutton releases a quantity of product from the aerosol container through the valve and the pushbutton. More recently, aerosol spray devices have been modified to look more like trigger sprayers and such devices may include a trigger attached to, or in communication with, a manifold which is connected to the valve of an aerosol container. Actuation of the trigger may release product from the aerosol container through the valve, into the manifold, and out an orifice of the trigger spray device. In many instances, the costs of trigger actuated aerosol sprayers are higher than those of pushbutton-type valves due to the increased piece parts and complexity of such devices.

While the aerosol pushbutton actuators and trigger actuators are usable, new, alternative, or improved methods for delivering or actuating a spray from aerosol containers or other containers are desirable. In addition, a reduction in costs is also desirable, especially in the case of trigger actuated aerosol sprayers and spray devices.

BRIEF SUMMARY OF THE INVENTION

According to certain embodiments of the invention an aerosol trigger actuator may include at least two parts: a trigger and a body. The trigger may be attached to the body and a portion of the trigger may flex to contact a portion of the body which moves a manifold integrated with the body. Movement of a portion of the trigger may actuate the manifold such that product in a container attached to the aerosol trigger actuator may be released.

In some embodiments of the invention, one or more living hinges integrated with a trigger and a body may facilitate the movement of a manifold integrated with the body. The living hinges may also facilitate repeated actuation of a trigger such that the aerosol trigger actuator may be attached to a container containing a product and used to evacuate the contents of the container.

BRIEF DESCRIPTION OF THE DRAWINGS

While the specification concludes with claims particularly pointing out and distinctly claiming particular embodiments of the present invention, various embodiments of the invention can be more readily understood and appreciated by one of ordinary skill in the art from the following descriptions of various embodiments of the invention when read in conjunction with the accompanying drawings in which:

DETAILED DESCRIPTION OF THE INVENTION

According to various embodiments of the invention, an aerosol trigger sprayer may include two or more parts. According to some embodiments, an aerosol trigger sprayer may include a body including an integrally molded manifold and actuator post. A trigger and cap piece may mate with or attach to the body and may include an integrally formed trigger which may interact with the actuator post of the body. One or more living hinges molded or designed in the trigger and body may allow the trigger to be actuated such that the trigger flexes the actuator post which in turn moves the manifold and opens a valve allowing a product to flow from a container, through the valve, through the manifold and out an orifice.

Figure 1:
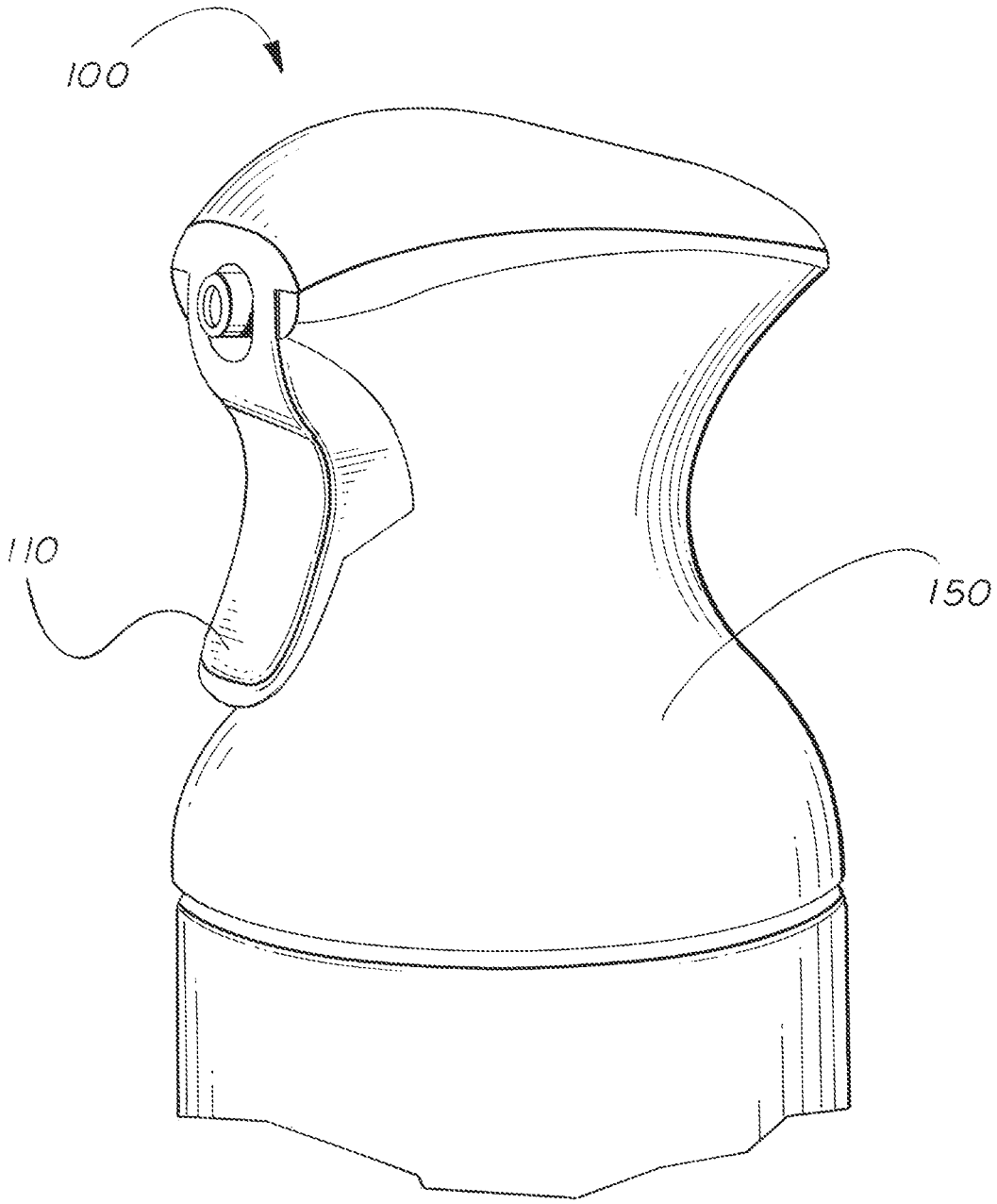
FIG. 1 illustrates an aerosol trigger sprayer according to embodiments of the invention.

Aerosol trigger sprayers according to various embodiments of the invention are illustrated in FIGS. 1 through 6. An aerosol trigger sprayer 100 according to various embodiments of the invention is illustrated in FIG. 1. An aerosol trigger sprayer 100 may include a trigger 110 and a body 150. The trigger 110 may be integrated with, or part of, a cap which attaches to, or may be connected to, the body 150. In various embodiments of the invention, one or more living hinges may be associated with the trigger 110, the body 150, or both the trigger 110 and the body 150.

Figure 2:
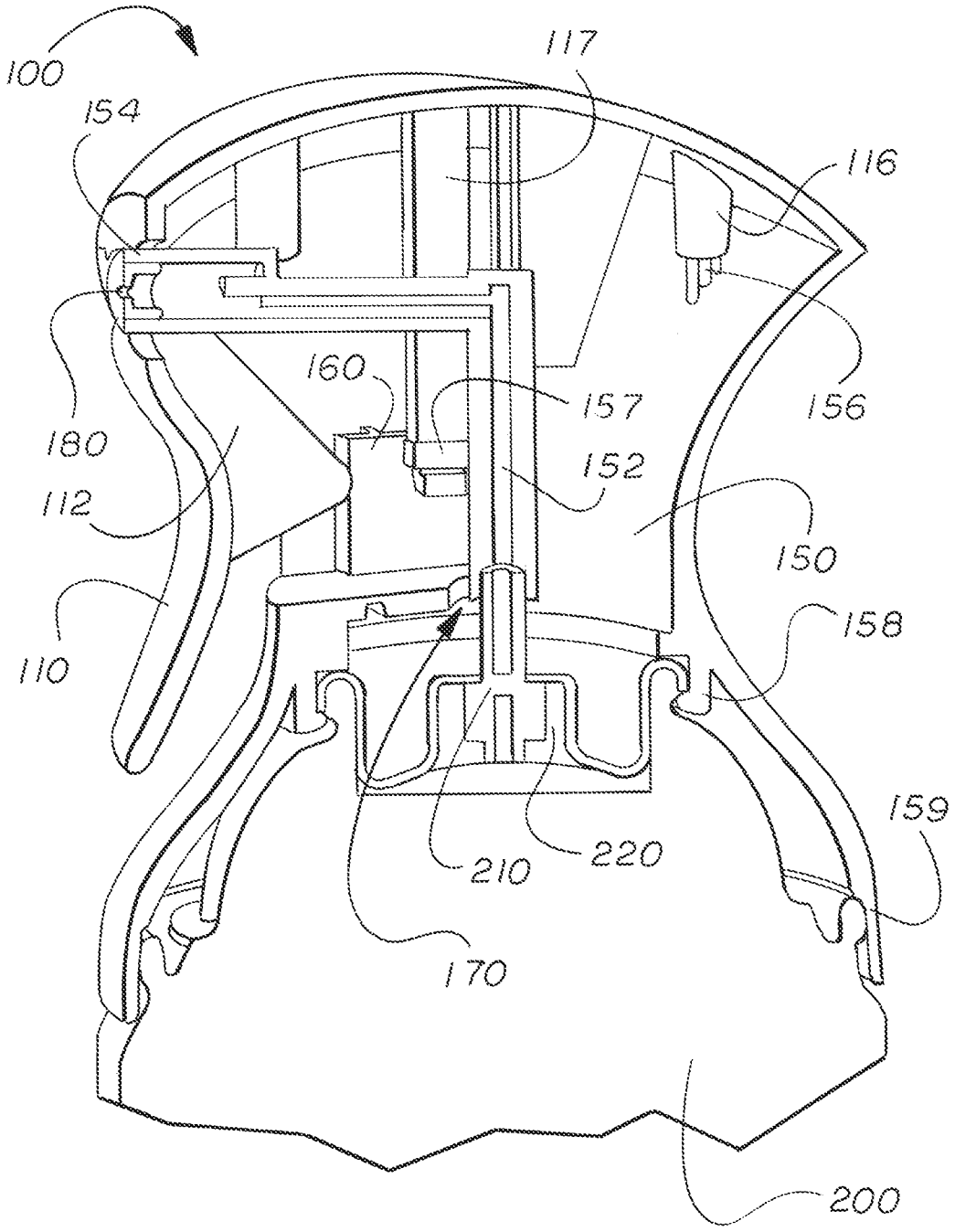
FIG. 2 illustrates a cross-sectional view of an aerosol trigger sprayer according to certain embodiments of the invention.

FIG. 2 illustrates a cross-sectional view of an aerosol trigger sprayer 100 according to certain embodiments of the invention. A trigger 110 is connected to, or attached to, a body 150. The body 150 may include one or more posts 156 which mate with, snap into, or rest in one or more post retainers 116 of the trigger 110. Alternatively, the trigger 110 may include posts and the body 150 may include post retainers as needed. The trigger 110 may also include one or more snap fitments 117 arranged to snap into and retain the trigger 110 with the body 150. The one or more snap fitments 117 may snap into one or more retainers 157 integrated with the body. Alternatively, the snap fitments may be part of the body 150 and the retainers part of the trigger 110.

According to embodiments of the invention, a body 150 of an aerosol trigger sprayer 100 may include an integrated manifold 152 and actuator post 160. A manifold 152 may be molded with the body 150 such that the desired manifold 152 characteristics are achieved. For example, the manifold 152 may include a shape or configuration to fit with a particular valve size or configuration as needed. An actuator post 160 may be connected to the manifold 152 by one or more living hinges 170. The body 150 may also include a discharge chamber 154 as part of the manifold 152. The discharge chamber 154 may include an orifice 180 integrally molded therewith or inserted into a portion of the discharge chamber 154. An orifice 180, whether inserted into the discharge chamber 154 or molded with the manifold 152, may provide desired spin mechanics for the aerosol trigger sprayer 100.

According to embodiments of the invention, the trigger 110 may include a trigger post 112 attached thereto or molded therewith. The trigger post 112 may be configured to contact the actuator post 160 of the body 150 when the trigger 110 is actuated. The trigger 110 may also include one or more living hinges allowing a portion of the trigger 110 to flex when a force is applied to the trigger 110.

In some embodiments of the invention, an aerosol trigger sprayer 100 may be connected to a container 200 containing a product, such as an aerosol product. One or more portions of the body 150 may snap onto a container 200 or onto a valve cap 220 connected to a container 200 as illustrated in FIG. 2. A valve 210 fitted to the valve cap 220 and container 200 may mate with, or be in communication with, a portion of the manifold 152. For example, aerosol trigger sprayers 100 according to embodiments of the invention may be connected to conventional aerosol containers using conventional valve systems. The body 150 of an aerosol trigger sprayer 100 may include a snap fit latch 158 which may snap around or connect to a rim of a container 200 or valve cap 220. The body 150 may also include a lip 159 or snap fitment to rest on or attach to a rim on a container.

Figure 3:
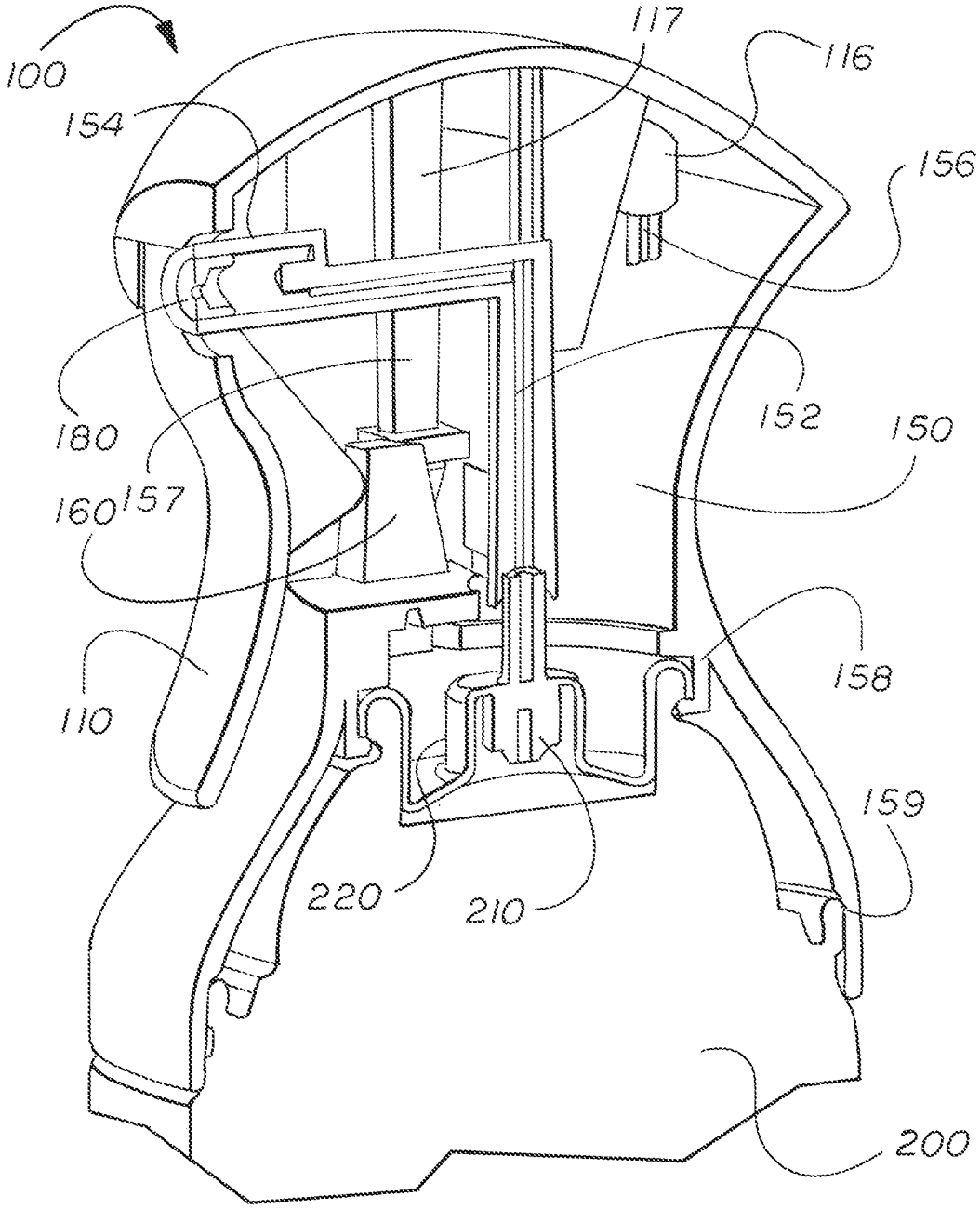
FIG. 3 illustrates a cross-sectional view of an aerosol trigger sprayer according to certain embodiments of the invention.

An alternative view of an aerosol trigger sprayer 100 according to various embodiments of the invention is illustrated in FIG. 3.

Figure 4:
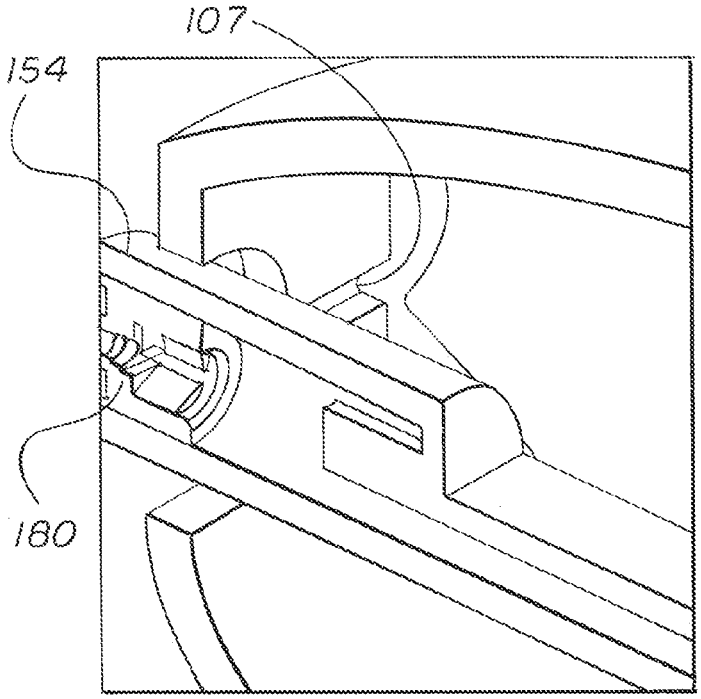
FIG. 4 illustrates a blown-up view of a living hinge incorporated with an aerosol trigger sprayer according to various embodiments of the invention.

According to various embodiments of the invention, one or more living hinges may be formed in the trigger 110 to allow a portion of the trigger 110 to flex or move when a force is applied to that portion of the trigger 110. As illustrated in FIG. 4, a trigger 110 may include a trigger living hinge 107 around an opening through which a portion of the manifold 152 or discharge chamber 154 extends. The trigger living hinge 107 may allow a trigger portion of the trigger 110 to flex when the trigger 110 is actuated. Upon a release of force on the trigger 110, the trigger living hinge 107 may allow or facilitate trigger 110 return to a non-actuated position. While FIG. 4 illustrates one side of a trigger living hinge 107 in the cross-sectional view, it is understood that the trigger living hinge 107 may extend on the other side of the trigger 110 as well. Further, placement of a trigger living hinge 107 is not limited to the placement illustrated in FIG. 4. It is understood that one or more trigger living hinges 107 may be integrated with the trigger 110 to allow the trigger 110 to flex and actuate an aerosol trigger sprayer 100 according to embodiments of the invention.

Figure 5:
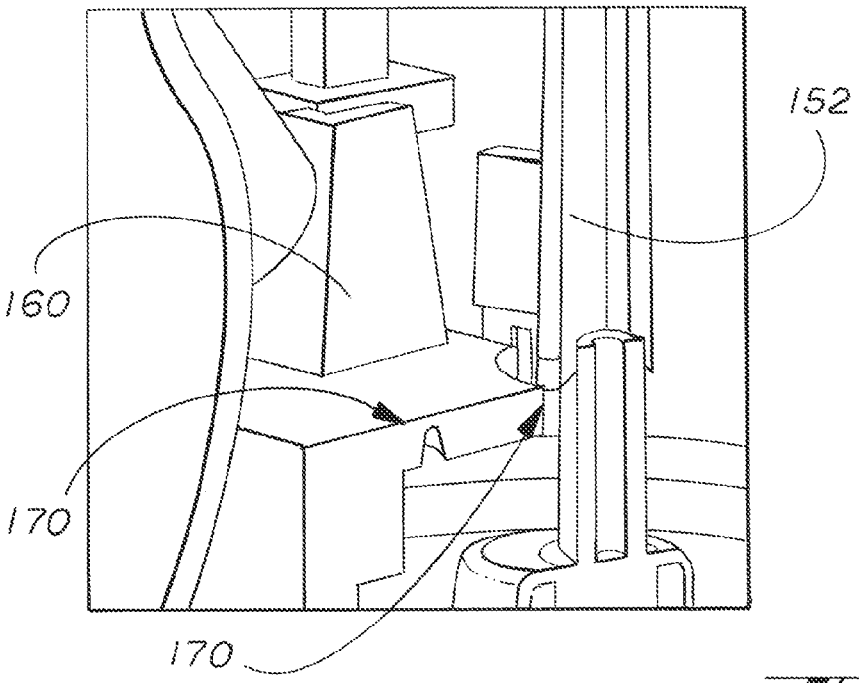
FIG. 5 illustrates a blown-up view of living hinges incorporated with an aerosol trigger sprayer according to embodiments of the invention.

As a trigger 110 is actuated and a trigger living hinge 107 flexes, the trigger post 112 may contact or interact with an actuator post 160 of the body 150. One or more living hinges 170 on the body 150 may flex as a force is applied to the actuator post 160. A living hinge 170 between the actuator post 160 and the manifold 152 may flex and push or pull the manifold 152 in a downward motion. At the same time, a second living hinge 170 may open allowing the actuator post 160 to move. As the actuator post 160 flexes the one or more living hinges 170 and moves the manifold 152, the manifold 152 may press on a valve 210 and open the valve 210, releasing product from a container 200 through the valve 210 and through the manifold 152. FIG. 5 illustrates a living hinge 170 configuration according to one embodiment of the invention. While the living hinges 170 illustrated in FIG. 5 may be used with embodiments of the invention, other configurations of one or more living hinges 170 may be used to facilitate actuation of a manifold 152 with a valve 210.

Figure 6:
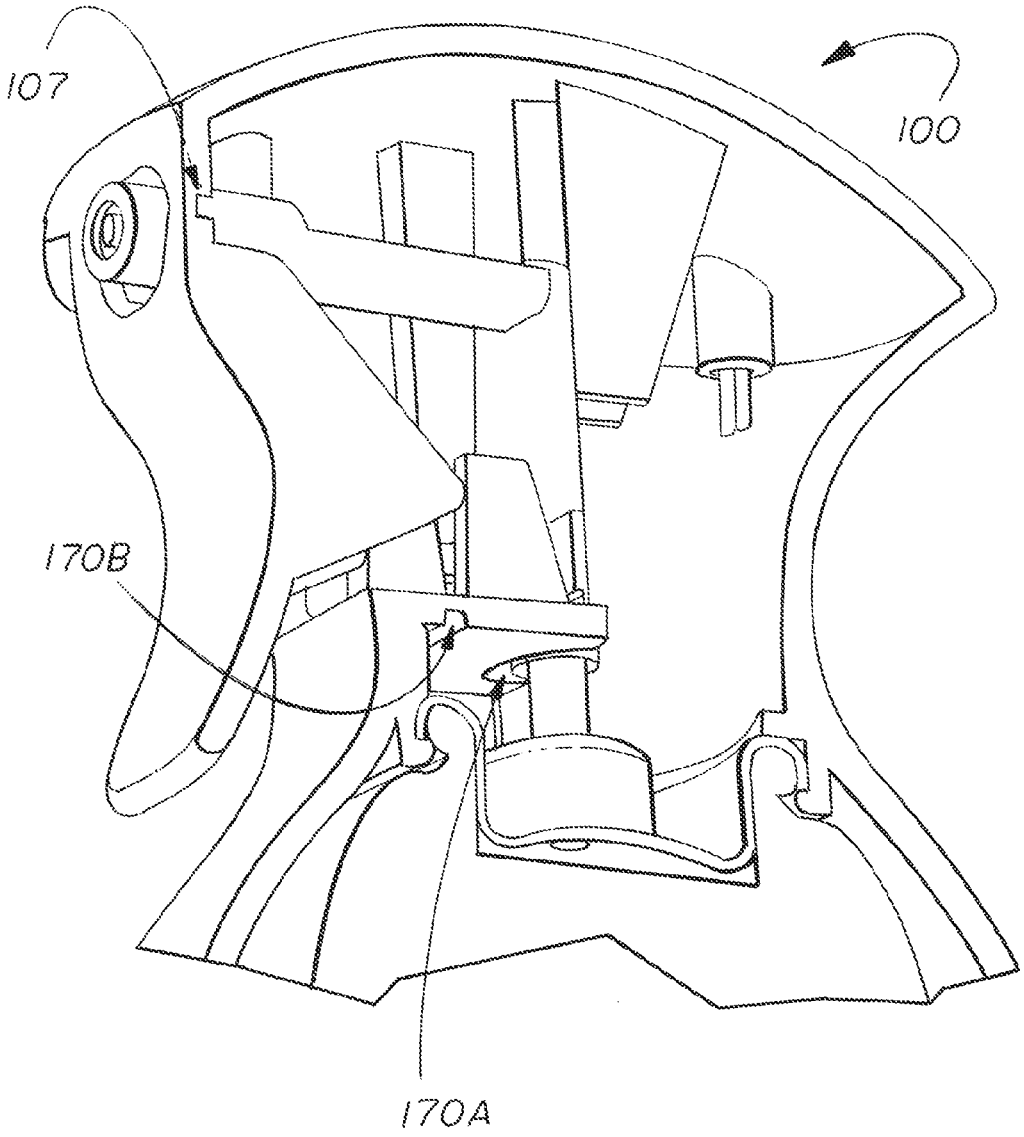
FIG. 6 illustrates a cross-sectional view of an aerosol trigger sprayer according to certain embodiments of the invention.

FIG. 6 illustrates an aerosol trigger sprayer 100 according to embodiments of the invention. As illustrated, the trigger 110 may include a single trigger living hinge 107 and the body may include a manifold living hinge 170A and an actuator post living hinge 170B. As a force is applied to the trigger 110, a portion of the trigger 110 below the trigger living hinge 107 flexes and applies a force to the actuator post 160. The actuator post 160, in turn, flexes about the actuator post living hinge 170B and applies force to the manifold living hinge 170A which pushes or pulls the manifold 152 down onto a valve 210, opening the valve and releasing product from a container 200 through the valve 210 and into the manifold 152. When the force on the trigger 110 is released, the trigger living hinge 107 moves the trigger 110 back into a non-actuated position and the living hinges 170A and 170B move the actuator post 160 into a non-actuated position, relieving the force on the manifold 152 and closing the valve 210.

Figure 7:
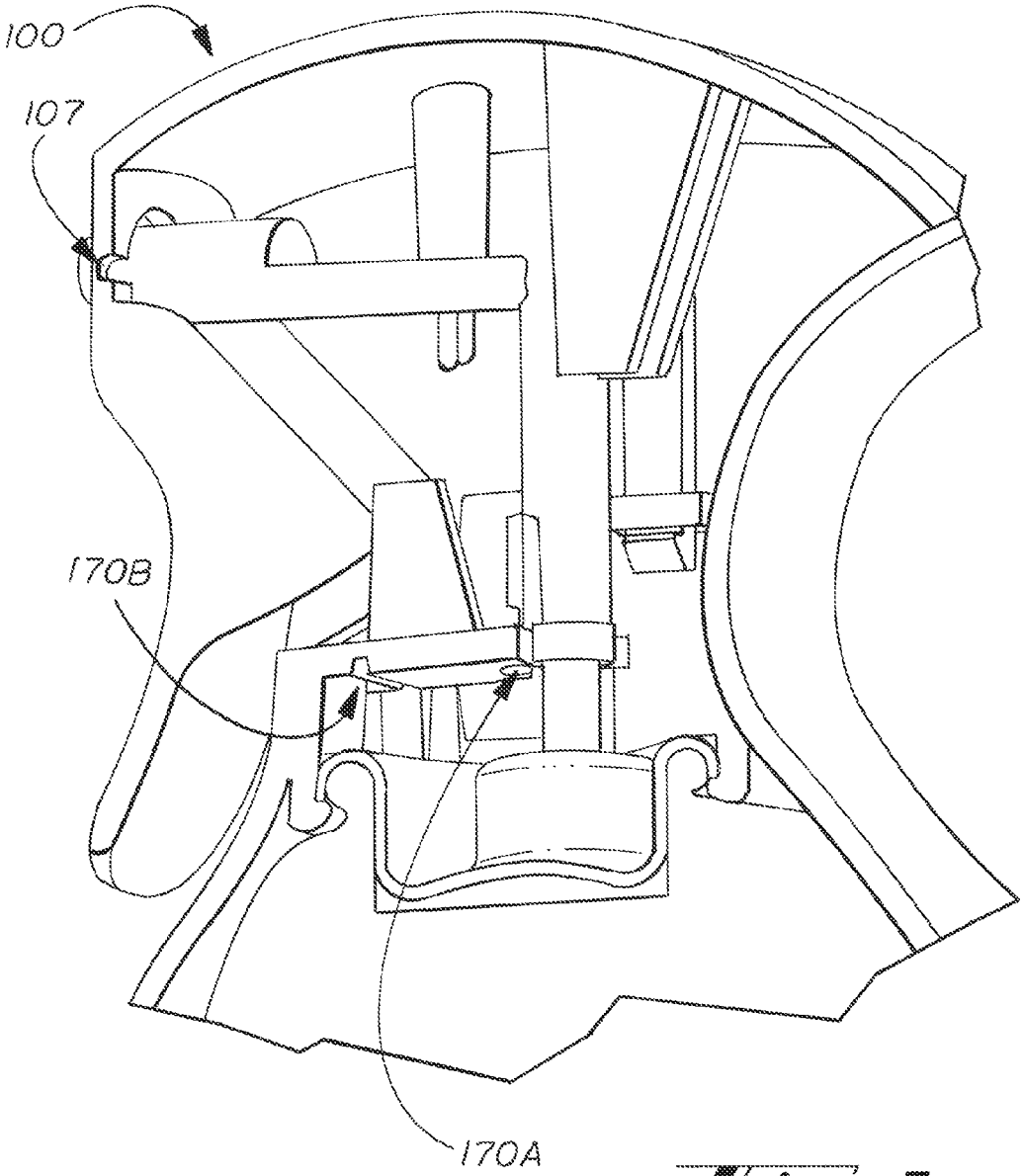
FIG. 7 illustrates a cross-sectional view of an aerosol trigger sprayer according to certain embodiments of the invention.

FIG. 7 illustrates a different perspective of the trigger living hinge 107 and the body 150 living hinges 170 according to various embodiments of the invention.

According to embodiments of the invention, the trigger 110 and body 150 of an aerosol trigger sprayer 100 may be molded from plastic or other resin material. The trigger 110 may be molded as a single piece and the body 150 may be molded as a single piece. The trigger 110 and body 150 may be assembled together and then assembled on a container 200 as known. Thus, in some embodiments, a two-piece aerosol trigger actuator 100 may be made. In other embodiments, an orifice 180 or orifice cup may be inserted into a discharge chamber 154 such that an aerosol trigger actuator 100 includes three parts.

Figure 8A:
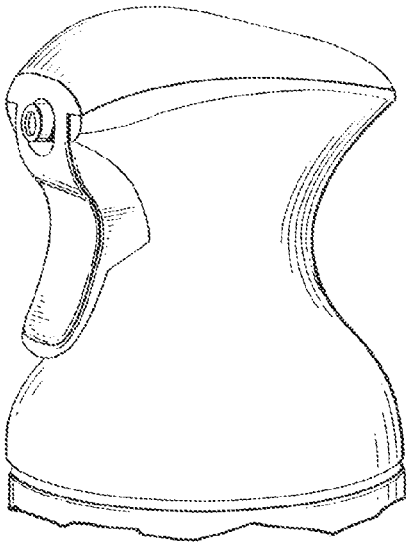
FIGS. 8A-8F illustrate the aesthetic design of an exterior of an aerosol trigger sprayer according to one embodiment of the invention.
Figure 8B:
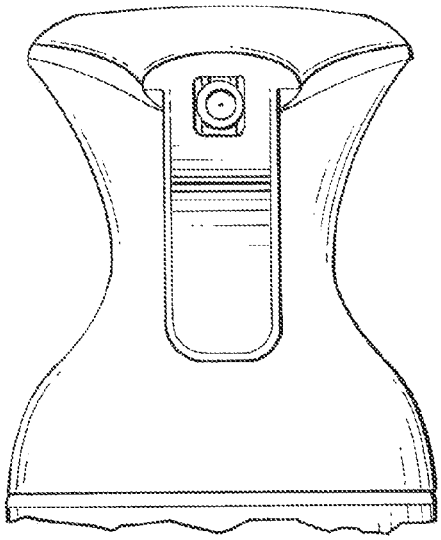
Figure 8C:
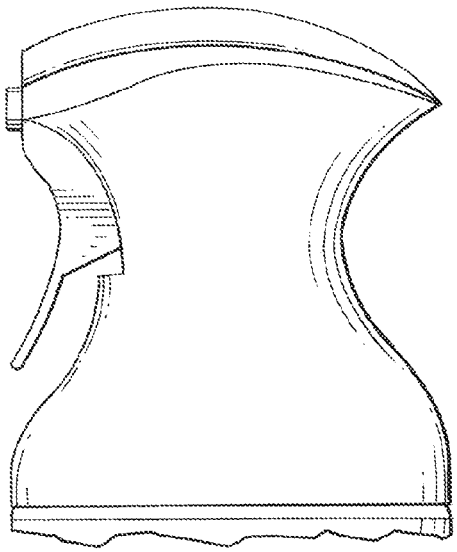
Figure 8D:
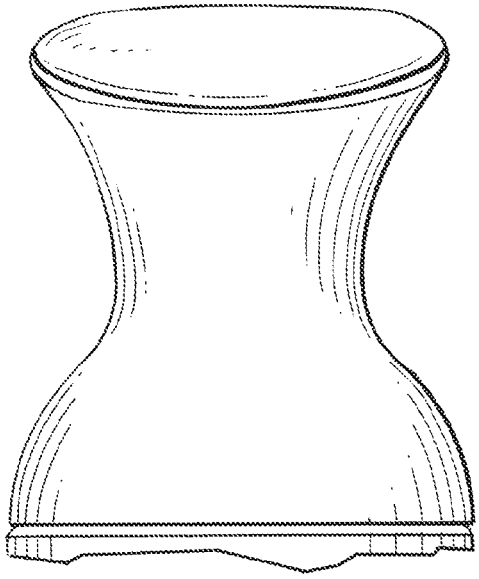
Figure 8E:
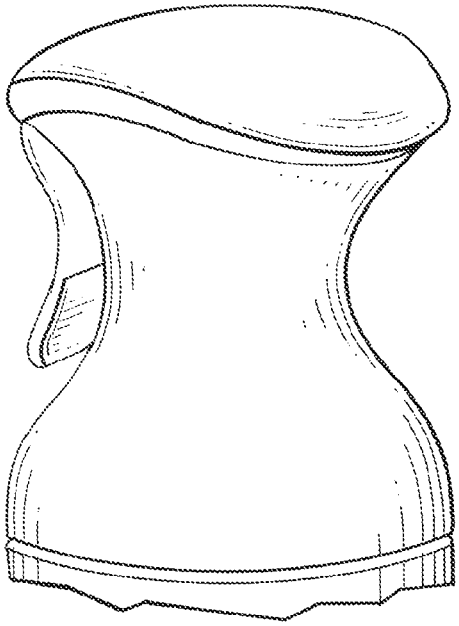
Figure 8F:
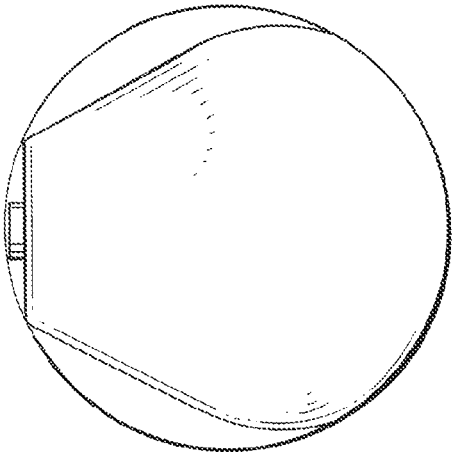

According to embodiments of the invention, the trigger 110 and body 150 of an aerosol trigger sprayer 100 may be molded or configured in any desired shape. An example of an aesthetic of an aerosol trigger sprayer 100 according to one embodiment of the invention is illustrated in FIGS. 8A through 8F, wherein, FIG. 8A illustrates a perspective view of the design, FIG. 8B illustrates a front view of the design, FIG. 8C illustrates a side view of the design, FIG. 8D illustrates a rear view of the design, FIG. 8E illustrates a rear perspective view of the design, and FIG. 8F illustrates a top view of the design.

Having thus described certain particular embodiments of the invention, it is understood that the invention defined by the appended claims is not to be limited by particular details set forth in the above description, as many apparent variations thereof are contemplated. Rather, the invention is limited only be the appended claims, which include within their scope all equivalent devices or methods which operate according to the principles of the invention as described.

What is claimed is:

1. An aerosol trigger sprayer comprising:

a trigger portion molded in one piece and comprising a trigger living hinge and a trigger post;

a plastic body;

an actuator post molded in one piece with the plastic body and connected thereto through a second living hinge;

a manifold molded in one piece with the plastic body and connected to the actuator post through a third living hinge;

the trigger portion configured to pivot about the trigger living hinge and move the trigger post against the actuator post;

the actuator post configured to pivot about the second living hinge in response to movement of the trigger post;

the actuator post further configured so that movement of the actuator post is transferred to the manifold through the third living hinge.

2. The aerosol trigger sprayer of claim 1, further comprising a cap portion molded in one piece with the trigger portion and trigger living hinge.

3. The aerosol trigger sprayer of claim 1, further comprising a container connected to the body.

4. The aerosol trigger sprayer of claim 3, further comprising an aerosol product in the container.

5. The aerosol trigger sprayer of claim 1, wherein the trigger comprises a plastic material.

6. The aerosol trigger sprayer of claim 1, wherein the body comprises a plastic material.

7. The aerosol trigger sprayer of claim 1, further comprising an orifice cup seated in a discharge end of the manifold.

8. An aerosol dispensing system, comprising:

a container;

a product contained in the container;

a valve in communication with the container; and an aerosol trigger sprayer connected to the container, comprising:

a trigger portion molded in one piece and comprising a trigger living hinge and a trigger post;

a plastic body;

an actuator post molded in one piece with the plastic body and connected thereto through a second living hinge a manifold molded in one piece with the plastic body and connected to the actuator post through a third living hinge;

the trigger portion configured to pivot about the trigger living hinge and move the trigger post against the actuator post;

the actuator post configured to pivot about the second living hinge in response to movement of the trigger post;

the actuator post further configured so that movement of the actuator post is transferred to the manifold through the third living hinge.

9. The aerosol dispensing system of claim 8, wherein the manifold is connected to the valve.

10. The aerosol dispensing system of claim 8, wherein the plastic body further comprises at least one post and the plastic trigger further comprises at least one post retainer, wherein the at least one post retainer mates with the at least one post.

11. The aerosol dispensing system of claim 8, wherein the plastic body further comprises at least one retainer and the plastic trigger comprises at least one snap fitment, wherein the at least one snap fitment is secured to the at least one retainer.

12. A two-piece aerosol trigger sprayer, comprising:

a molded plastic body, comprising:

a body shell;

an actuator post;

an actuator post living hinge between and connecting the body shell to the actuator post;

a manifold;

a manifold living hinge between and connecting the actuator post to the manifold; and at least one post;

a molded plastic trigger attached to the molded plastic body, comprising:

a cap;

at least one post retainer extending off of the cap and encircling the at least one post of the molded plastic body;

a trigger extending away from the cap;

a living hinge between the cap and trigger;

an opening between the cap and the trigger, wherein a discharge end of the manifold is positioned in the opening; and a trigger post extending off of the trigger and in contact with the actuator post.

13. The two-piece aerosol trigger sprayer of claim 12, wherein the opening between the cap and the trigger bisects the living hinge between the cap and trigger.

14. The two-piece aerosol trigger sprayer of claim 12, wherein the manifold further comprises a discharge chamber at a discharge end of the manifold.

15. The two-piece aerosol trigger sprayer of claim 12, wherein the manifold further comprises a discharge chamber and an orifice at a discharge end of the manifold.

16. The two-piece aerosol trigger sprayer of claim 12, further comprising:

at least one snap fitment extending off of the cap; and at least one retainer on the molded plastic body, wherein the at least one snap fitment is secured in the at least one retainer.

17. The two-piece aerosol trigger sprayer of claim 12, further comprising:

at least one snap fitment extending off of the molded plastic body; and at least one retainer on the cap, wherein the at least one snap fitment is secured in the at least one retainer.

* * * * *